US009517857B2

(12) United States Patent
Klein

(10) Patent No.: US 9,517,857 B2
(45) Date of Patent: Dec. 13, 2016

(54) CARDBOARD BOX, BLANK AND METHOD OF MAKING A CARDBOARD BOX

(71) Applicant: Braun GmbH, Kronberg (DE)

(72) Inventor: Heinrich Klein, Niedernhausen (DE)

(73) Assignee: BRAUN GMBH, Kronberg (DE)

( * ) Notice: Subject to any disclaimer, the term of this patent is extended or adjusted under 35 U.S.C. 154(b) by 0 days.

(21) Appl. No.: 14/864,830

(22) Filed: Sep. 24, 2015

(65) Prior Publication Data

US 2016/0096651 A1 Apr. 7, 2016

(30) Foreign Application Priority Data

Oct. 1, 2014 (EP) ..... 14187256

(51) Int. Cl.

| | |
|---|---|
| ***B65D 5/46*** | (2006.01) |
| ***B31B 1/14*** | (2006.01) |
| ***B31B 1/26*** | (2006.01) |
| ***B31B 1/86*** | (2006.01) |
| ***B65D 5/42*** | (2006.01) |
| ***B31B 1/62*** | (2006.01) |

(52) U.S. Cl.

CPC ..... *B65D 5/46104* (2013.01); *B31B 1/14* (2013.01); *B31B 1/26* (2013.01); *B31B 1/62* (2013.01); *B31B 1/86* (2013.01); *B65D 5/4208* (2013.01)

(58) Field of Classification Search

CPC ..... B65D 5/46104; B65D 5/46112; B65D 5/16096; B65D 5/46128; B65D 5/46136; B65D 5/46144; B65D 5/46096; B65D 5/461444; B31B 1/14; B31B 1/26; B31B 1/62; B31B 1/86

USPC ..... 229/117.13, 117.14, 117.22; 206/427

See application file for complete search history.

(56) References Cited

U.S. PATENT DOCUMENTS

| | | | | |
|---|---|---|---|---|
| 2,849,112 A * | 8/1958 | Forrer | B65D 71/20 206/141 |
| 2,874,870 A * | 2/1959 | Collura | B65D 71/20 206/141 |
| 3,662,946 A * | 5/1972 | Marinissen | B65D 5/46072 229/117.14 |
| 4,195,765 A * | 4/1980 | Roccaforte | B65D 5/46088 229/117.15 |
| 2013/0032500 A1 | 2/2013 | Thivolet | |

FOREIGN PATENT DOCUMENTS

| | | | |
|---|---|---|---|
| CA | 609726 | 11/1960 | |
| FR | 1274610 | 10/1961 | |
| GB | 403086 A * | 12/1933 | B65D 5/46096 |

(Continued)

OTHER PUBLICATIONS

European Search Report for CM2141Q dated May 13, 2015, 10 pages.

*Primary Examiner* — Gary Elkins

(57) ABSTRACT

A cardboard box has a fold-out hanger arranged in a cut-out of the cardboard box, wherein at least a hanger portion of the cardboard box is assembled from two layers of cardboard, the hanger portion having a first hanger portion formed from a first cardboard layer and a second hanger portion formed from a second cardboard layer, wherein a first hanger section of the first hanger portion forms a front side of the hanger, a second hanger section of the second hanger portion forms a backside of the hanger and the second hanger section is smaller in lateral extension than the first hanger section.

11 Claims, 4 Drawing Sheets

(56) References Cited

FOREIGN PATENT DOCUMENTS

| | | |
|---|---|---|
| GB | 1513897 | 6/1978 |
| JP | 2004196310 | 7/2004 |
| JP | 2011105335 | 6/2011 |

* cited by examiner

CARDBOARD BOX, BLANK AND METHOD OF MAKING A CARDBOARD BOX

FIELD OF THE INVENTION

The present invention is concerned with a cardboard box having a fold-out hanger, with a blank for making said cardboard box and with a method of making a cardboard box.

BACKGROUND OF THE INVENTION

It is known that cardboard boxes have a hanger that in particular has a punching-out in the form of a eurohole for hanging the cardboard box onto wire-hooks. It is known that such hangers can be portions sticking out from the cardboard box. It is also known that a hanger may be arranged as a fold-out part that stays in a folded position during transport and that is folded apart just prior to hanging it to, e.g., a wire-hook.

U.S. Pat. No. 4,195,765 discloses a carton with an integrally formed handle. The handle is formed from first and second congruent handles, which handle is selectively movable from a horizontal to a vertical position for carrying said carton, in particular by rupturing nicks or interruptions and pivoting the glued handles about their corresponding base lines to a vertical position.

It is an object of the present disclosure to provide a cardboard box with a hanger that is improved over the known cardboard boxes having a hanger or that at least provides an alternative design. It is further an object of the present disclosure to provide a blank for making such an improved cardboard box and to provide a method of making such an improved cardboard box.

SUMMARY OF THE INVENTION

In accordance with at least one aspect there is provided a cardboard box having a fold-out hanger arranged in a cut-out of the cardboard box, wherein at least a hanger portion of the cardboard box is assembled from two layers of cardboard, the hanger portion having a first hanger portion formed from a first cardboard layer and a second hanger portion formed from a second cardboard layer, wherein a first hanger section of the first hanger portion forms a front side of the hanger, a second hanger section of the second hanger portion forms a backside of the hanger and the second hanger section is smaller in its lateral extensions than the first hanger section.

In accordance with at least one aspect there is provided a blank for making a cardboard box, the blank comprising a hanger portion having a first hanger portion and a second hanger portion, the first hanger portion having a first cutout in which a first hanger section is arranged and the second hanger portion having a second cutout in which a second hanger section is arranged, wherein the first hanger section is integrally connected with a first frame section of the first hanger portion along a perforated or otherwise weakened separation line in a top area of the hanger and the second hanger section is separated from a second frame section of the second hanger portion by a separation gap in a top area of the hanger.

In accordance with at least one aspect there is provided a method of making a cardboard box comprising the steps of: providing a layer of cardboard, slitting and scoring the layer of cardboard such that a blank results having a hanger portion comprising a first hanger portion having a first hanger section being arranged in a first cutout and a second hanger portion having a second hanger section being arranged in a second cutout, where the second hanger section is smaller in its lateral extension than the first hanger section, and folding the blank such that the first hanger section overlays the second hanger section such that the first cutout and the second cutout are aligned with each other.

BRIEF DESCRIPTION OF THE DRAWINGS

The proposed cardboard box, blank and method of making a cardboard box are described with respect to example embodiments in the following description, where reference is made to figures. In the figures

DETAILED DESCRIPTION OF THE INVENTION

In the present disclosure the term "cardboard" will be used. This term shall include all types of cardboards or paperboards as well as all types of corrugated (fiber-)boards, where the corrugated board can be single or double faced and may have single wall or multiple wall structure.

A cardboard box in accordance with the present disclosure has a hanger portion having a fold-out hanger arranged in a cut-out of the hanger portion surrounded by a frame, which frame and hanger are each made from two layers of cardboard (which two layers are in particular glued to each other). The cut-out may in particular be larger in size than the hanger to allow easy access to the hanger in order to swing it out. The upper cardboard layer of the hanger (i.e. the first hanger section) is integrally connected with the upper cardboard layer of the frame (i.e. the first frame section) at a top area and at a bottom area of the hanger to keep the hanger in place (i.e. in its folded position), which may be desired e.g. during transport of the cardboard box. The upper cardboard layer of the hanger is connected with the upper cardboard layer of the frame only via a weakened line, in particular a perforated cut line, so that the hanger can be swung-out with applying only a limited force. The lower cardboard layer of the hanger (i.e. the second hanger section) is not integrally connected with the lower cardboard layer of the frame (i.e. the second frame section) in a top area of the hanger but is actually arranged with a distance in this top area from the lower cardboard layer of the frame section (i.e. separated by a separation gap from the lower frame layer), so that the second hanger section will not become locked against the first frame section and the hanger can be easily folded apart when this is desired (e.g. when the cardboard box shall be positioned on a wire-hook). In some embodiments, the lower hanger layer is also smaller than the upper hanger layer with respect to its width (i.e. the lateral dimension perpendicular to an axis connecting the bottom and the top areas of the hanger).

The upper cardboard layer of the hanger (i.e. the first hanger section) may be integrally connected with the upper cardboard layer of the frame (i.e. the first frame section) along a folding line (e.g. a scorer line or double scorer line). The lower cardboard layer of the hanger (i.e. the second hanger section) may be integrally connected with the lower cardboard layer of the frame (i.e. the second frame section) along a folding line (e.g. a cut line). Both, the upper cardboard layer and the lower cardboard layer of the hanger (i.e. the first and the second hanger sections) may comprise a punching-out, e.g. in the form of a eurohole, which punching-outs essentially align to form a punching-out of the hanger.

Figure 1A:
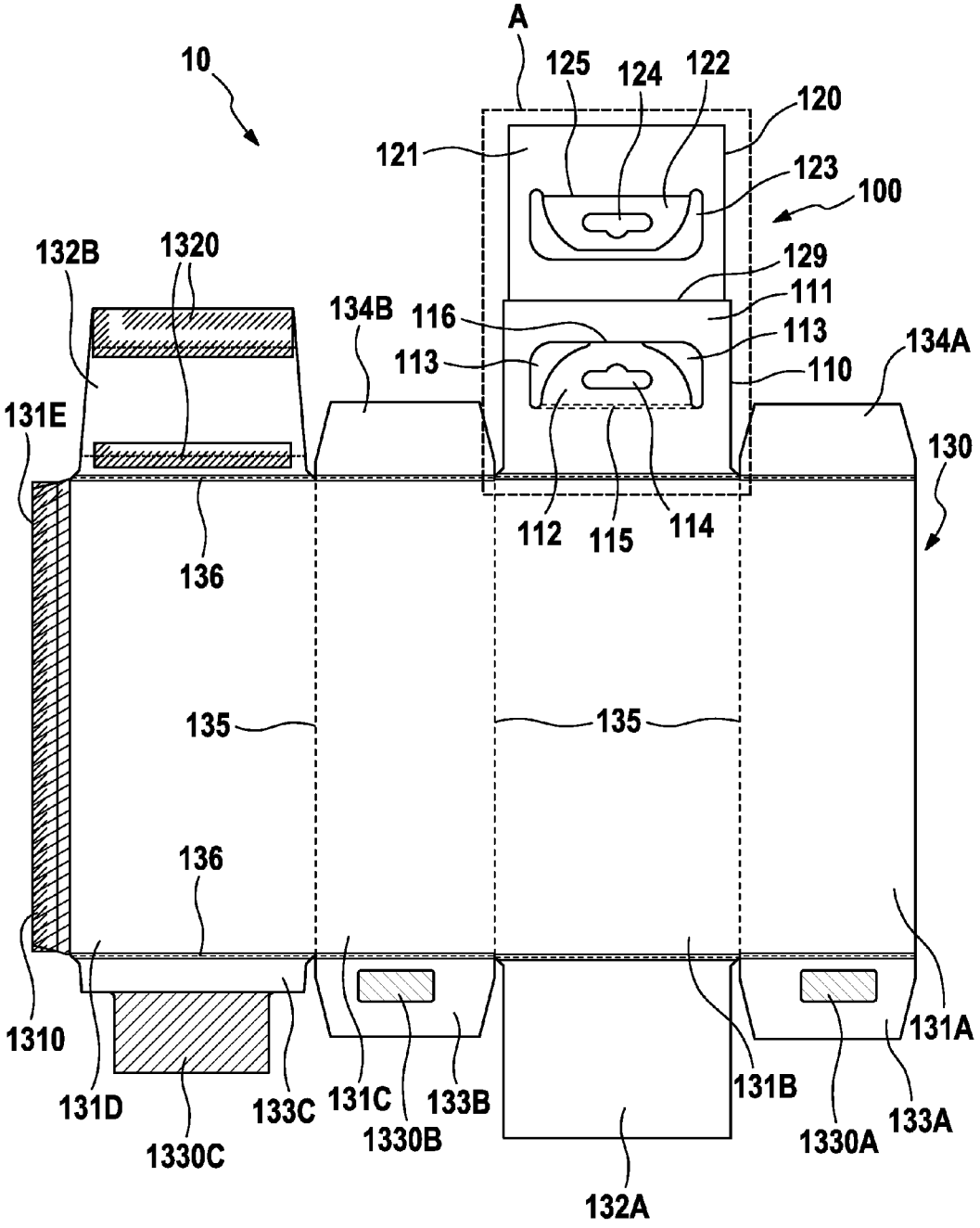
FIG. 1A is a depiction of an example embodiment of a blank (i.e. a punched-out, stamped and partially cut cardboard or corrugated board) having a hanger portion for making a cardboard box in accordance with the present disclosure.
Figure 1B:
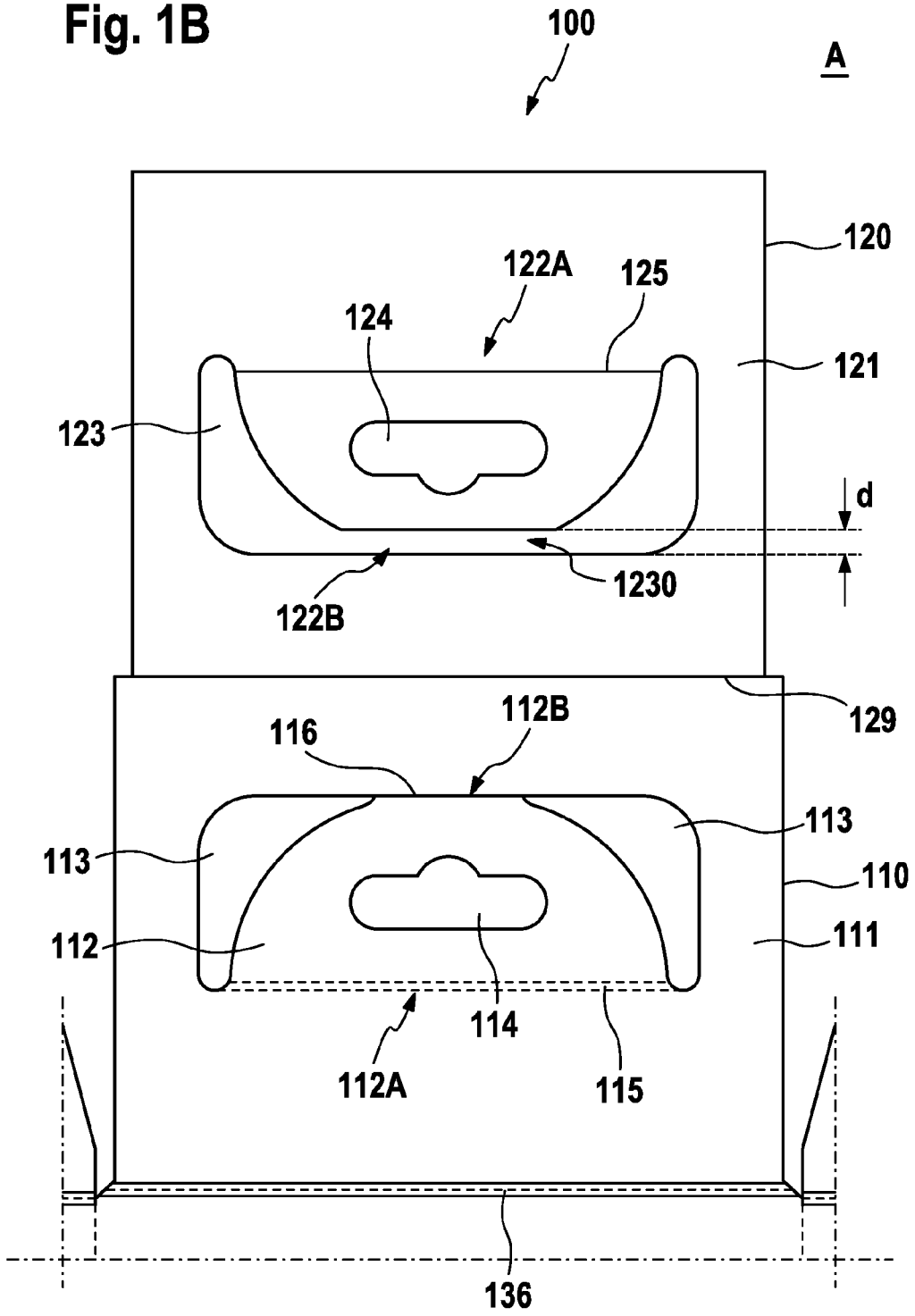
FIG. 1B is a magnified depiction of the hanger portion A indicated in FIG. 1A.
Figure 3:
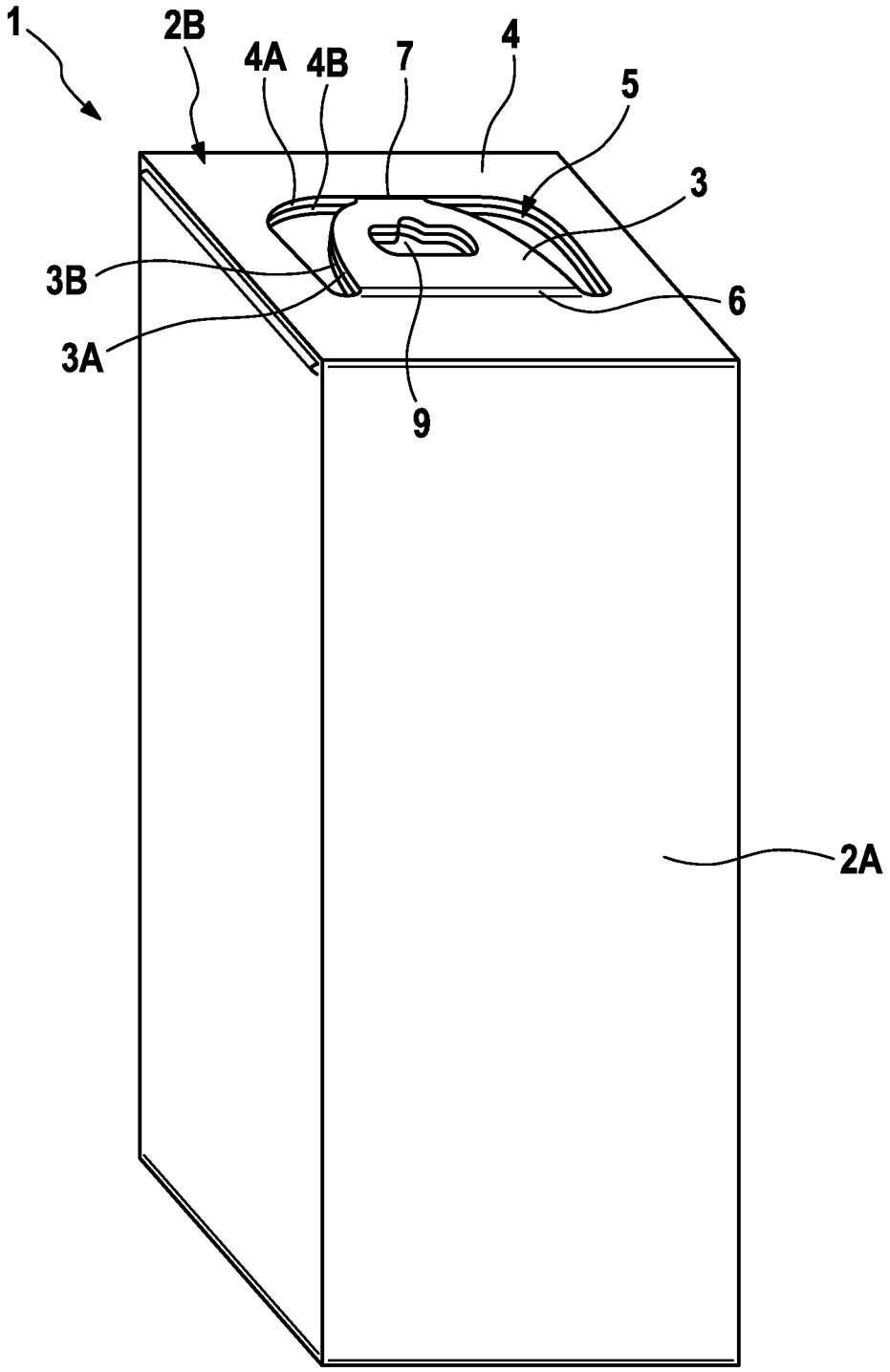
FIG. 3 is a depiction of an example embodiment of a cardboard box made from the blank shown in FIG. 1A, where the hanger is not folded out.

FIG. 1A is a depiction of an example embodiment of a blank 10 in accordance with the present disclosure for making a folded cardboard box (see FIG. 3). FIG. 1A is a view onto the outer face of the blank 10. The blank 10 has been made from a layer of cardboard by e.g. punching-out, cutting and/or stamping (e.g. using an automatic slitter/scorer machine such as available from MarquipWardUnited, Wisconsin, USA or from Mitsubishi Heavy Industries, Ltd.). The blank 10 comprises a hanger portion 100 and a box portion 130. A magnification of the hanger portion 100 indicated by dashed box A is shown in FIG. 1B. Thus, reference is made to FIGS. 1A and 1B for discussion of the hanger portion 100.

The hanger portion 100 as shown in FIGS. 1A and 1B comprises a first hanger portion 110 and a second hanger portion 120 that are hinged together by a folding line 129, which may in particular be realized as a cut line extending partially through the cardboard layer, but this should not be considered as limiting and other weakened folding lines are considered as well.

The first hanger portion 110 comprises a first frame section 111 and a first hanger section 112 that is arranged in a first cut-out 113 of the first hanger portion 110 (where the first cut-out 113 is larger in its lateral extensions that the first hanger section 110 in order to allow access to the first hanger section. The first hanger section 112 extends from a bottom area 112A, where the first hanger section 112 is integrally connected with the first frame section 111, to a top area 112B, where the first hanger section 112 is as well integrally connected with the first frame section 111. A folding line 115 hinges the first hanger section 112 to the first frame section 111 in the bottom area 112A and a snapping-off line 116 connects the first hanger section 112 to the first frame section 111 in the top area 112B. The folding line 115 may in particular be realized as a scorer line, further in particular as a double scorer line. This should not be interpreted as limiting and other weakened folding lines are also envisaged. The snapping-off line 116 may in particular be realized as a perforated line so that the top area 112B of the first hanger section 112 can easily be snapped off from the first frame section 111 in order to swing-out the hanger in the final cardboard box. But this should not be interpreted as limiting and other weakened snapping-off lines may be considered as well.

The second hanger portion 120 comprises a second frame section 121 and a second hanger section 122 arranged in a second cut-out 123 of the second hanger portion 120. The second hanger section 122 extends from a bottom area 122A, where the second hanger section 122 is integrally connected with the second frame section 121, to a top area 122B, where the second hanger section 122 is arranged with a separation gap 1230 having a gap width d to the second frame section 121. A folding line 125 hinges the second hanger section 122 to the second frame section 121 in the bottom area 122A. The folding line 125 may in particular be realized as a cut line extending partially through the cardboard layer. This should not be interpreted as limiting and other weakened folding lines are also envisaged.

In the process of making a cardboard box out of the blank 10, the backsides of the first and second hanger portions 110 and 120 are glued together after the second hanger portion 120 is folded around folding line 129 extending between the first and the second hanger portions. Folding line 129 may in particular be a partial cut line, i.e. a line where a cut only goes through a front face liner (if such is present) of the cardboard and (in case of a corrugated board) also at least partially through the corrugated layer.

The box portion 130 comprises in the shown embodiment four lateral wall portions 131A, 131B, 131C, and 131D so that a cardboard box of rectangular or rhombic cross section can be made. Lateral wall portions 131A and 131D can be connected via a lateral flap 131E on which a glue area 1310 is provided. In other embodiments, only three, or five or more lateral wall portions may be present so that a cardboard box of triangular or pentagonal etc. cross section could be made. This should not exclude that other cardboard boxes are considered as well, e.g. cardboard boxes having a pyramidal shape or a generally polyhedron type of 3D shape. Box portion 130 as shown also comprises bottom flaps 133A, 133B, and 133C that cooperate with a bottom wall section 132A to form a bottom closure of the cardboard box. In order to connect the bottom flaps and the bottom wall section 132A, glue areas 1330A, 1330B and 1330C are provided on the bottom flaps so that in the course of folding together the cardboard box, these portions are connected. An adhesive may be applied to the glue areas as is know in the art, e.g. by screen printing or ink-jet printing of suitable adhesives including non-reactive adhesives (e.g. drying, pressure sensitive, contact or hot melt adhesives) and one-part or multi-part reactive adhesives. A top cover of the cardboard box can be assembled from top flaps 134A and 134B and top wall section 132B. When folded together and glued to each other, the hanger made from the first and second hanger sections is connected with the top wall section 132B along glue areas 1320 (i.e. the front face of the second hanger section 120 is glued onto the glue areas 1320 applied on the front face of the top wall section 132B such that the second hanger section 122 is not connected with the top wall section 132B). As mentioned before, the backsides of the first and second hanger portions 110 and 120 are also glued together so that the first and the second frame sections 111 and 121 and the first and second hanger sections 112 and 122 are connected. At least one glue area is provided on at least one of the backsides of the first and second hanger sections 110 and 120, which glue area is not shown. In some embodiments, an essentially continuous glue area is provided on the backside of the second hanger portion 120. The here shown structure of the blank 10 (i.e. sizes and number of the wall sections and flap sections and positions of the glue area etc.) shall not be interpreted as limiting and any blank can be considered having a double-layer hanger as discussed.

Figure 2A:
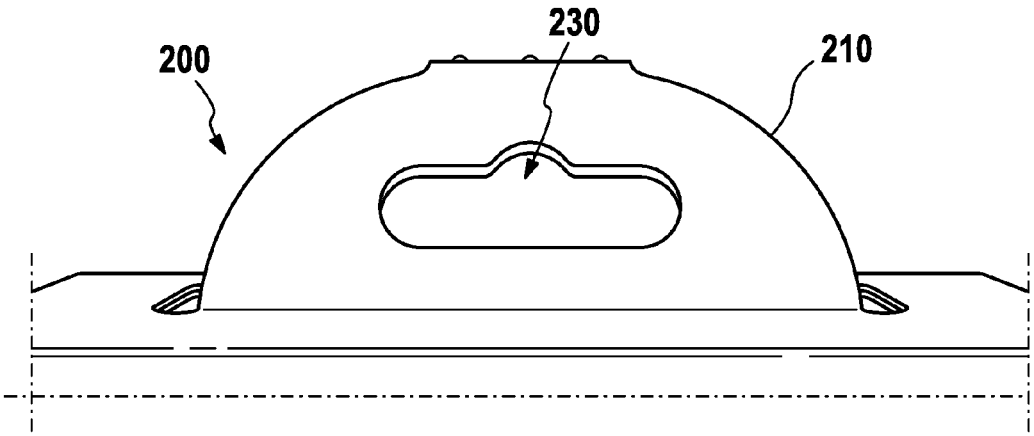
FIG. 2A is a depiction of an upper portion of an example embodiment of a cardboard box in accordance with the present disclosure, where a hanger is folded-out and the front face of the hanger is visible.
Figure 2B:
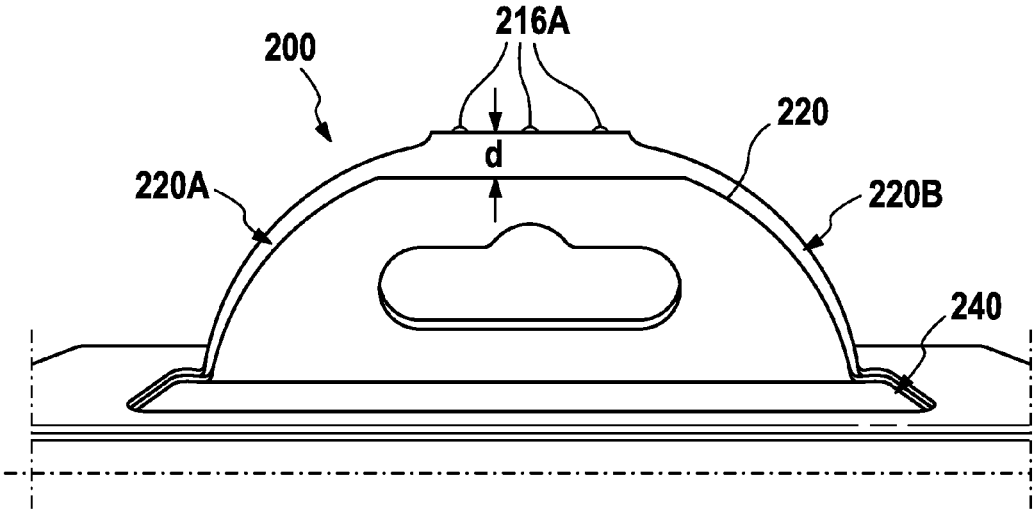
FIG. 2B is a depiction of the same upper portion of the example cardboard box shown in FIG. 2A, but where the rear face of the hanger is shown.

FIGS. 2A and 2B show depictions of the top area of a cardboard box with a fold-out hanger 200 shown in its swung-out position (i.e. after the hanger 200 has been snapped out of the respective cut-out formed by the aligned first and second cut-outs). FIG. 2A shows a front view onto the hanger 200 and FIG. 2B shows a rear view onto the swung-out hanger 200. The hanger 200 has a punching-out 230 in the form of a eurohole (even though other punching-out shapes are considered as well). The punching-out 230 of hanger 200 is formed from a first punching-out in a first hanger section 210 and a second punching-out in a second hanger section 220 (as has been discussed before), wherein the punching-outs are essentially aligned ("essentially" here relates to the tolerances in the manual or automated folding process of making the cardboard box). In the step of folding together of the first and second hanger sections as discussed with reference to FIG. 1B, in particular during an automated folding process, a certain misalignment of the two hanger portions may result. The respective tolerance may lie in the area of about ±0.5 mm to about ±2 mm for typical cardboard box sizes in the area of 5 cm to 40 cm (even though the tolerance in the slitting and scoring of the blank itself may be not higher than about ±0.5 mm) In a design with a second hanger section being identical to the first hanger section discussed before, this could result in a misalignment of the snapping-off lines of the first and second hanger sections and in particular the second hanger section would then potentially get locked under the first frame section. Thus, the present disclosure proposes to realize the second hanger section 220 with smaller lateral extension than the first hanger section. In particular, the second hanger section may not extend at all until the separation line between the first hanger section and the first frame section and may be arranged with a separation gap to the second frame section as has been discussed with reference to FIGS. 1A and 1B. The width d of the separation gap may be chosen to be larger than the respective misalignment tolerance, e.g. the gap width d may be at least 1 mm, at least 2 mm, at least 3 mm, at least 4 mm etc. In some embodiments, the gap width d may be more than 1.5 times the misalignment tolerance value, in particular more than 2 times the misalignment tolerance value (e.g. the gap width would then be at least 4 mm if the misalignment tolerance is ±2 mm) In the shown embodiment, the second hanger section 220 is also smaller in its sideways extension than the first hanger section 210 so that the first hanger section 210 projects over the second hanger section 220 in side areas 220A and 220B of the hanger. The first hanger section 210 had been integrally connected with the first frame section along a snapping-off line via three small cardboard bridges 216 so that the snapping-off of the hanger 200 out of the cut-out 230 could be established with applying only a small force.

FIG. 3 shows an assembled cardboard box 1 that may have been made from a blank identical or similar to the blank shown in FIG. 1A. The cardboard box 1 comprises a box body 2A and a hanger portion 2B made from a double layer of cardboard. The hanger portion 2B comprises a frame 4, which frame 4 is connected (here: glued) to a top of the box body 2A, and a fold-out hanger 3 that is arranged in a cut-out 5 of the hanger portion 2B, which cut-out 5 allows for easy access to the sides of the hanger 3. The hanger 3 comprises an upper cardboard layer 3A and a lower cardboard layer 3B that in particular may be glued together. The frame 4 comprises an upper cardboard layer 4A and a lower cardboard layer 4B that may in particular be glued together. The upper cardboard layer 3A of the hanger 3 (i.e. the first hanger section) is at least partially integrally connected with the upper cardboard layer 4A of the frame 4 (i.e. the first frame section) along a folding line 6 (which may be realized as a scorer line) and along a snapping-off line 7 that may be realized as a perforated cut line so that the hanger 3 can be swung out of the cut-out 5 with applying only a limited force, whereby the snapping-off line 7 gets ruptured. The lower cardboard layer 3B of the hanger 3 (i.e. the second hanger section) is at least partially integrally connected with the lower cardboard layer 4B of the frame 4 (i.e. the second frame section) along a folding line in the bottom area of the hanger underneath and coinciding in position with folding line 6 and does not extend until the lower cardboard layer 4B of the frame 4 but is separated from this by a gap having a gap width (i.e. the second hanger section is smaller in its lateral extensions than the first hanger section and in particular the second hanger section does not extend until the second hanger section does not extend until the snapping off line 7). The cut-out 5 has a size so that a user can enter at least one finger into each of the cut-out portions formed on the sides of the hanger 3 in order to apply a force onto the hanger 3 and to rupture the snapping-off line 7. Before a force is applied at the hanger 3, the hanger 3 is securely held in place and the cardboard box 1 can be efficiently transported without any sticking-out hanger portion. The hanger 3 has a punching-out 9, which is here shown to have the shape of a eurohole, even though this should not be considered as limiting and any other punching shape is possible.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A cardboard box having a fold-out hanger arranged in a cut-out of the cardboard box, wherein the cardboard box is made of a blank comprising a hanger portion having a first hanger portion and a second hanger portion, the first hanger portion having a first cutout in which a first hanger section is arranged and the second hanger portion having a second cutout in which a second hanger section is arranged, wherein the first hanger section is integrally connected with a first frame section of the first hanger portion along a perforated or otherwise weakened separation line in a top area of the hanger and the second hanger section is separated from a second frame section of the second hanger portion by a separation gap in a top area of the hanger.

2. The cardboard box in accordance with claim 1, wherein the second hanger section does not extend until the separation line between the first hanger section and the first frame section.

3. The cardboard box in accordance with claim 1, wherein the second hanger section is integrally connected with the second frame section along a partially pre-cut or otherwise weakened folding line in the bottom area of the hanger.

4. The cardboard box in accordance with claim 1, wherein the second hanger section is smaller in size than the first hanger section in side areas of the hanger.

5. The cardboard box in accordance with claim 1, wherein the first hanger portion and the second hanger portion are glued together.

6. The cardboard box in accordance with claim 1, wherein each of the hanger sections comprises a punching-out.

7. A blank for making a cardboard box, the blank comprising a hanger portion having a first hanger portion and a second hanger portion, the first hanger portion having a first cutout in which a first hanger section is arranged and the second hanger portion having a second cutout in which a second hanger section is arranged, wherein the first hanger section is integrally connected with a first frame section of the first hanger portion along a perforated or otherwise weakened separation line in a top area of the hanger and the second hanger section is separated from a second frame section of the second hanger portion by a separation gap in a top area of the hanger.

8. The blank in accordance with claim 7, wherein the first hanger portion and the second hanger portion are hinged together along a folding line such that when folded together the first hanger section overlays the second hanger section such that the first cutout and the second cutout become aligned with each other.

9. The blank in accordance with claim 7, wherein the first hanger section and the second hanger section each comprise identical punching-out portions such that when the first hanger portion and the second hanger portion are folded together, the punching-out portions become aligned with each other.

10. A method of making a cardboard box comprising the steps of:

providing a layer of cardboard comprising a blank comprising a hanger portion having a first hanger portion and a second hanger portion, the first hanger portion having a first cutout in which a first hanger section is arranged and the second hanger portion having a second cutout in which a second hanger section is arranged, wherein the first hanger section is integrally connected with a first frame section of the first hanger portion along a perforated or otherwise weakened separation line in a top area of the hanger and the second hanger section is separated from a second frame section of the second hanger portion by a separation gap in a top area of the hanger;

slitting and scoring the layer of cardboard such that the blank results having the hanger portion comprising the first hanger portion having the first hanger section being arranged in the first cutout and the second hanger portion having the second hanger section being arranged in the second cutout, where the second hanger section is smaller in its lateral extension than the first hanger section; and folding the blank such that the first hanger section overlays the second hanger section such that the first cutout and the second cutout are aligned with each other.

11. The method in accordance with claim 10, further comprising the step of gluing together the first hanger portion and the second hanger portion.

* * * * *